US011272771B2

(12) United States Patent
Bell et al.

(10) Patent No.: US 11,272,771 B2
(45) Date of Patent: Mar. 15, 2022

(54) SAFETY ENHANCING STORAGE BAG

(71) Applicants: Carolyn Bell, Conyers, GA (US); Jonathan Bell, Sr., Conyers, GA (US)

(72) Inventors: Carolyn Bell, Conyers, GA (US); Jonathan Bell, Sr., Conyers, GA (US)

( * ) Notice: Subject to any disclaimer, the term of this patent is extended or adjusted under 35 U.S.C. 154(b) by 202 days.

(21) Appl. No.: 16/746,140

(22) Filed: Jan. 17, 2020

(65) Prior Publication Data

US 2021/0219687 A1 Jul. 22, 2021

(51) Int. Cl.

| | |
|---|---|
| ***A45C 13/24*** | (2006.01) |
| ***A45C 15/06*** | (2006.01) |
| ***A45C 3/06*** | (2006.01) |

(52) U.S. Cl.

CPC ..... *A45C 13/24* (2013.01); *A45C 3/06* (2013.01); *A45C 15/06* (2013.01)

(58) Field of Classification Search

CPC ..... A45C 15/06; A45C 13/18

See application file for complete search history.

(56) References Cited

U.S. PATENT DOCUMENTS

| | | | | |
|---|---|---|---|---|
| 1,706,387 | A * | 3/1929 | Kramer | F41C 9/02 109/67 |
| 5,408,220 | A * | 4/1995 | Brown | A45C 13/18 150/110 |
| 8,768,141 | B2 * | 7/2014 | Chan | H04N 5/772 386/224 |
| 9,364,063 | B1 * | 6/2016 | Dandia | G08B 13/126 |
| 10,129,503 | B1 * | 11/2018 | Kim | G06F 1/163 |
| 10,230,827 | B2 * | 3/2019 | DiPerna | H04M 1/026 |
| 2007/0102077 | A1 * | 5/2007 | Parker-Ogden | A45C 11/008 150/111 |
| 2014/0050468 | A1 * | 2/2014 | Henry | A45C 13/30 396/423 |
| 2018/0255894 | A1 * | 9/2018 | Knittel | A63B 55/00 |
| 2019/0014242 | A1 * | 1/2019 | Piekarski | G06F 1/1686 |
| 2019/0343257 | A1 * | 11/2019 | Ragans | A45C 15/06 |

* cited by examiner

*Primary Examiner* — John K Fristoe, Jr.
*Assistant Examiner* — Justin Caudill
(74) *Attorney, Agent, or Firm* — The Iwashko Law Firm, PLLC; Lev Ivan Gabriel Iwashko

(57) ABSTRACT

A safety enhancing storage bag, including a main body to store at least one first item therein, a strap assembly disposed on at least a portion of the main body to suspend the main body in response to being worn by a user, a plurality of cameras removably disposed on at least a portion of the strap assembly to record a video of a predetermined duration, and an alarm system disposed on at least a portion of the strap assembly to output an alarm in response to activating the alarm system.

8 Claims, 1 Drawing Sheet

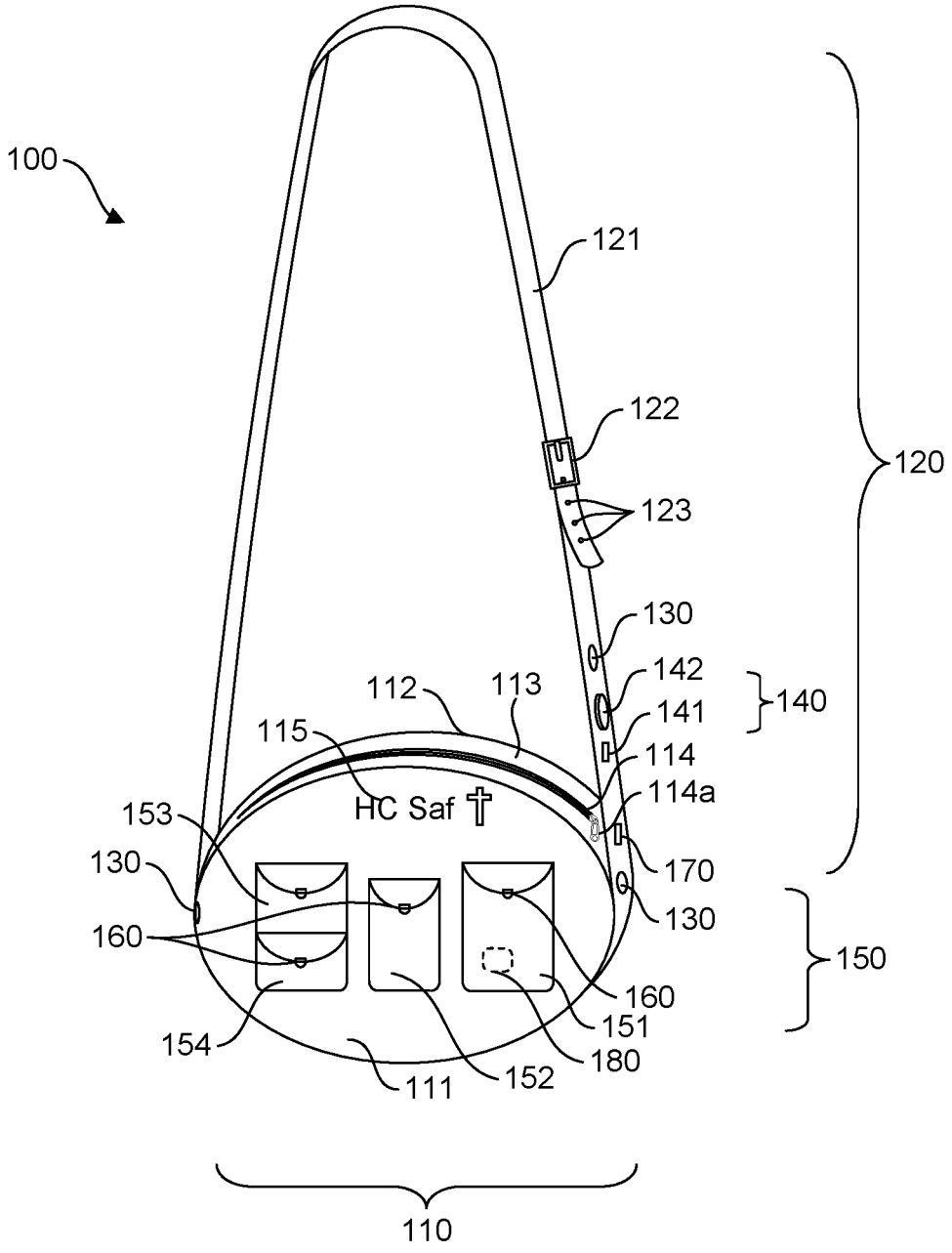
100
121
122
123
120
130
142
141
140
112
113
115
114
114a
HC Saf
153
170
130
130
160
150
160
151
154
180
152
111
110

SAFETY ENHANCING STORAGE BAG

BACKGROUND

1. Field

The present general inventive concept relates generally to a storage bag, and particularly, to a safety enhancing storage bag.

2. Description of the Related Art

Ensuring one's safety and protection is an essential component of self-preservation. However, people are often unable to immediately notify someone of an impending threat or carry deterrents to ward off physical violence in a discreet fashion. Unfortunately, a user holding a typical bag is at an increased risk of violence because of an inability to defend themselves.

Most conventional storage bags, such as a purse or satchel are used during the day to carry the user's personal belongings. However, the conventional storage bags do not have any safety measures for the user.

Therefore, there is a need for storage bags that provide safety measures for the user.

SUMMARY

The present general inventive concept provides a safety enhancing storage bag.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a safety enhancing storage bag, including a main body to store at least one first item therein, a strap assembly disposed on at least a portion of the main body to suspend the main body in response to being worn by a user, a plurality of cameras removably disposed on at least a portion of the strap assembly to record a video of a predetermined duration, and an alarm system disposed on at least a portion of the strap assembly to output an alarm in response to activating the alarm system.

The strap assembly may include an adjustable strap, and a strap fastener disposed on at least a portion of the adjustable strap to adjust a length of the adjustable strap.

The alarm system may include an output unit to perform at least one of emitting an alarm sound, illuminating a light, and displaying a word on an LED display, and an output button connected to the output unit to activate or deactivate the output unit.

The plurality of cameras may record the video in response to depressing the output button.

The safety enhancing storage bag may further include at least one pocket removably disposed on at least a portion of the main body to store at least one second item therein.

The at least one pocket may detach in response to a predetermined level of force directed away from the main body.

The safety enhancing storage bag may further include a sensor disposed under the at least one pocket to send an alert signal to the alarm system in response to detecting the at least one pocket is detached from the main body, such that the alarm system outputs the alarm.

BRIEF DESCRIPTION OF THE DRAWINGS

These and/or other features and utilities of the present generally inventive concept will become apparent and more readily appreciated from the following description of the embodiments, taken in conjunction with the accompanying drawings of which:

FIG. 1 illustrates a side perspective view of a safety enhancing storage bag, according to an exemplary embodiment of the present general inventive concept.

DETAILED DESCRIPTION

Various example embodiments (a.k.a., exemplary embodiments) will now be described more fully with reference to the accompanying drawings in which some example embodiments are illustrated. In the FIGURES, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Safety Enhancing Storage Bag 100
Main Body 110
First Side 111
Second Side 112
Oval Side 113
Main Fastener 114
Main Grip 114*a*
Indicia 115
Strap Assembly 120
Adjustable Strap 121
Strap Fastener 122
Strap Apertures 123
Cameras 130
Alarm System 140
Output Unit 141
Output Button 142
Pockets 150
First Pocket 151
Second Pocket 152
Third Pocket 153
Fourth Pocket 154
Pocket Lock 160
Power Source 170
Sensor 180

FIG. 1 illustrates a side perspective view of a safety enhancing storage bag 100, according to an exemplary embodiment of the present general inventive concept.

The safety enhancing storage bag 100 may be constructed from at least one of metal, plastic, wood, glass, and rubber, etc., but is not limited thereto.

The safety enhancing storage bag 100 may include a main body 110, a strap assembly 120, a plurality of cameras 130, an alarm system 140, a plurality of pockets 150, a pocket lock 160, a power source 170, and a sensor 180, but is not limited thereto.

Referring to FIG. 1, the main body 110 is illustrated to have an oval shape. However, the main body 110 may be a rectangular prism, rectangular, circular, pentagonal, hexagonal, octagonal, or any other shape known to one of ordinary skill in the art, but is not limited thereto.

The main body 110 may include a first side 111, a second side 112, an oval side 113, a main fastener 114, and an indicia 115, but is not limited thereto.

The first side 111 and the second side 112 may be disposed in parallel with respect to each other. The oval side 113 may be disposed between the first side 111 and the second side 112. Moreover, the oval side 113 is disposed around an edge of the first side 111 and an edge of the second side 112, such that the oval side 113 may include a top side and a bottom side of the main body 110.

Furthermore, the main body 110 may store at least one first item therein.

The main fastener 114 may include a main grip 114*a*, but is not limited thereto.

Referring again to FIG. 1, the main fastener 114 is illustrated to be a zipper. However, the main fastener 114 may be a twine, a string, a rope, a magnet, a clasp, a hook, a screw, a nail, a bolt, a nut, a washer, and/or any combination thereof, but is not limited thereto.

The main fastener 114 may be longitudinally disposed on at least a portion of the oval side 113, such that the main fastener 114 may be disposed on the top side of the main body 110. Alternatively, the main fastener 114 may be disposed on any portion of the main body 110. The main fastener 114 may at least partially open to allow access within the main body 110 in a first position and close to prevent access within the main body 110 in a second position.

The main grip 114*a* may facilitate gripping thereof. Also, the main grip 114*a* may include a symbol, a word, a letter, a phrase, a logo, an image, a picture, and/or any combination thereof.

The indicia 115 may include a symbol, a word, a letter, a phrase, a logo, an image, a picture, and/or any combination thereof. The indicia 115 may identify an origin of manufacture, such as a company and/or a person that created the safety enhancing storage bag 100. Additionally, the indicia 115 may be the same design as the main grip 114*a*.

The strap assembly 120 may include an adjustable strap 121, a strap fastener 122, and a plurality of strap apertures 123, but is not limited thereto.

A first end of the adjustable strap 121 may be disposed on a first portion of the oval side 113. Moreover, a second end of the adjustable strap 121 may be disposed on a second portion of the oval side 113. The adjustable strap 121 may have a predetermined length based on a preference of a user, such that the adjustable strap 121 may suspend the main body 110 in response to being worn on the user.

The strap fastener 122 is illustrated to be a buckle. However, the strap fastener 122 may be a zipper, a twine, a string, a rope, a magnet, a clasp, a hook, a screw, a nail, a bolt, a nut, a washer, and/or any combination thereof, but is not limited thereto.

The strap fastener 122 may be disposed on at least a portion of the adjustable strap 121.

Although, the plurality of strap apertures 123 are described in plurality, the plurality of strap fasteners 123 may be a single strap fastener 123.

At least one of the plurality of strap apertures 123 may connect to the strap fastener 122. As such, the strap fastener 122 may adjust a length of the adjustable strap 121 based on inserting the strap fastener 122 into the at least one of the plurality of strap apertures 123 being used.

Alternatively, the first end and the second end of the adjustable strap 121 may be disposed within the oval side 113, such that the length of the adjustable strap 121 may adjust in response to inserting a portion of the first end and/or a portion of the second end of the adjustable strap 121 into the oval side 113.

Each of the plurality of cameras 130 may include a storage unit, a communication unit, and a global positioning system (GPS), but is not limited thereto.

The storage unit may include a random access memory (RAM), a read-only memory (ROM), a hard disk, a flash drive, a database connected to the Internet, cloud-based storage, Internet-based storage, or any other type of storage unit.

The communication unit may include a device capable of wireless or wired communication between other wireless or wired devices via at least one of Wi-Fi, Wi-Fi Direct, infrared (IR) wireless communication, satellite communication, broadcast radio communication, Microwave radio communication, Bluetooth, Bluetooth Low Energy (BLE), Zigbee, near field communication (NFC), and radio frequency (RF) communication, USB, Firewire, and Ethernet.

Referring again to FIG. 1, each of the plurality of cameras 130 are removably disposed at different portions of the adjustable strap 121. For example, at least one of the plurality of cameras 130 may be disposed away from the main body 110 on an upper portion of the adjustable strap 121, and at least one other of the plurality of cameras 130 may be disposed on the oval side 113 at a juncture between the oval side 113 and the first end or the second end of the adjustable strap 121. As such, the plurality of cameras 130 may be oriented toward different surroundings with respect to the user, such that a side and/or a rear of the user may be recorded.

Alternatively, the plurality of cameras 130 may be removably disposed on different portions of the main body 110, such as the first side 111, the second side 112, and/or the oval side 113. Different positions of the plurality of cameras 130 may provide alternative angles of view for recording.

The plurality of cameras 130 may record a video to be stored on the storage unit. The plurality of cameras 130 may record for a predetermined duration. For example, the plurality of cameras 130 may record two hours of footage. Additionally, the plurality of cameras 130 may include a time stamp and a location stamp based on the GPS.

The plurality of cameras 130 may connect to an external device using the communication unit, such that the recording may be reviewed on the external device.

The alarm system 140 may include an output unit 141 and an output button 142, but is not limited thereto.

The alarm system 140 may be disposed on at least a portion of the adjustable strap 121. The output unit 141 may include a light, a light-emitting diode (LED) display, and a speaker, but is not limited thereto.

The output button 142 may include a button, a lever, a switch, and a dial, but is not limited thereto.

The output unit 141 may be connected to the output button 142 to activate (e.g., turn on) an alert in response to depressing the output button 142. For example, the output unit 141 may illuminate the light, display a word and/or phrase on the LED display, and/or emit an alarm sound in response to depressing the output button 142. As such, the user may depress the output button 142 to alert at least one other person that the user is experiencing an emergency, such as being attacked and/or is a victim of theft. The user may depress the output button 142 another time to deactivate (e.g., turn off) the alert.

Furthermore, the plurality of cameras 130 may begin recording in response to depressing the output button 142, such that the plurality of cameras 130 may be in an on state. In other words, the plurality of cameras 130 may be in an off state prior to depressing the output button 142.

The plurality of pockets 150 may include a first pocket 151, a second pocket 152, a third pocket 153, and a fourth pocket 154, but is not limited thereto.

Although, the plurality of pockets 150 are described in plurality, the plurality of pockets 150 may be a single pocket 150.

Each of the plurality of pockets 150 may be removably disposed on at least of the first side 111 and/or the second side 112. For example, the first pocket 151 and the second pocket 152 may be removably disposed on the first side 111, and the third pocket 153 and the fourth pocket 154 may be removably disposed on the second side 112 based on the preference of the user.

Moreover, each of the plurality of pockets 150 may resist removal, such that the first pocket 151, the second pocket 152, the third pocket 153, and the fourth pocket 154 may detach in response to a predetermined level of force directed away from the main body 110. In other words, the first pocket 151, the second pocket 152, the third pocket 153, and the fourth pocket 154 may detach during theft to prevent damage to the main body 110, and injury to the user.

The first pocket 151 may have a first length and/or size to store a mobile device and/or keys therein.

The second pocket 152 may have a second length and/or size to store a pepper spray device therein. As such, the second pocket 152 may store the pepper spray device to provide access for the user to a defensive item during an attack and/or theft against the user.

The third pocket 153 may have a third length and/or size to store at least one card therein. Additionally, the third pocket 153 may have a double fold, such that additional cards may be separated.

The fourth pocket 154 may have a fourth length and/or size to store at least one second item therein.

The pocket lock 160 may include a latch, a spring, a hook, and an electronic lock, but is not limited thereto.

The pocket lock 160 may be disposed on at least a portion of each of the plurality of pockets 150. The pocket lock 160 may lock each of the plurality of pockets 150 in a first lock position, and unlock each of the plurality of pockets 150 in a second lock position.

The power source 170 may be at least one of a battery and a solar cell, but is not limited thereto. Additionally, the battery may include lithium-ion, nickel cadmium, nickel metal hydride, alkaline, etc., but is not limited thereto.

The sensor 180 may be disposed on at least a portion of the main body 110 under each of the plurality of pockets 150. The sensor 180 may detect detachment of each of the plurality of pockets 150, such that the sensor 180 may send an alert signal to the alarm system 140. As such, the output unit 141 may illuminate the light, display the word and/or phrase on the LED display, and/or emit the alarm sound in response to receiving the alert signal from the sensor 180.

The power source 170 may send power to at least one of the alarm system 140 and the sensor 180.

Therefore, the safety enhancing storage bag 100 may protect the user from attack and/or injury from a thief by activating the alarm system 140 and/or the plurality of cameras 130, such that the thief may be deterred without using deadly force. Also, the safety enhancing storage bag 100 may capture images of the thief, such that an identity of the thief may be shared to assist in arrest of the thief.

The present general inventive concept may include a safety enhancing storage bag 100, including a main body 110 to store at least one first item therein, a strap assembly 120 disposed on at least a portion of the main body 110 to suspend the main body 110 in response to being worn by a user, a plurality of cameras 130 removably disposed on at least a portion of the strap assembly 120 to record a video of a predetermined duration, and an alarm system 140 disposed on at least a portion of the strap assembly 120 to output an alarm in response to activating the alarm system 140.

The strap assembly 120 may include an adjustable strap 121, and a strap fastener 122 disposed on at least a portion of the adjustable strap 121 to adjust a length of the adjustable strap 121.

The alarm system 140 may include an output unit 141 to perform at least one of emitting an alarm sound, illuminating a light, and displaying a word on an LED display, and an output button 142 connected to the output unit 141 to activate or deactivate the output unit 141.

The plurality of cameras 130 may record the video in response to depressing the output button 141.

The safety enhancing storage bag 100 may further include at least one pocket 150 removably disposed on at least a portion of the main body 110 to store at least one second item therein.

The at least one pocket 150 may detach in response to a predetermined level of force directed away from the main body 110.

The safety enhancing storage bag 100 may further include a sensor 180 disposed under the at least one pocket 150 to send an alert signal to the alarm system 140 in response to detecting the at least one pocket 150 is detached from the main body 110, such that the alarm system 140 outputs the alarm.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A safety enhancing storage bag, comprising:

a main body to store at least one first item therein;

a strap assembly disposed on at least a portion of the main body to suspend the main body in response to being worn by a user;

a plurality of cameras removably disposed on at least a portion of the strap assembly to record a video of a predetermined duration; and an alarm system disposed on at least a portion of the strap assembly to output an alarm in response to activating the alarm system, the alarm system comprising:

a light to illuminate that the user is experiencing an emergency, an LED display to display that the user is experiencing an emergency, and a speaker to emit a sound that the user is a victim of theft.

2. The safety enhancing storage bag of claim 1, wherein the strap assembly comprises:

an adjustable strap; and a strap fastener disposed on at least a portion of the adjustable strap to adjust a length of the adjustable strap.

3. The safety enhancing storage bag of claim 1, wherein the alarm system comprises:

an output button connected to the output unit to activate or deactivate at least one of the light, the LED display, and the speaker.

4. The safety enhancing storage bag of claim 3, wherein the plurality of cameras record the video in response to depressing the output button.

5. The safety enhancing storage bag of claim 1, further comprising:

at least one pocket removably disposed on at least a portion of the main body to store at least one second item therein.

6. The safety enhancing storage bag of claim 5, wherein the at least one pocket detaches in response to a level of force directed away from the main body.

7. The safety enhancing storage bag of claim 5, further comprising:

a sensor disposed under the at least one pocket to send an alert signal to the alarm system in response to detecting the at least one pocket is detached from the main body, such that the alarm system outputs the alarm.

8. A safety enhancing storage bag, comprising:

a main body to store at least one first item therein;

a strap assembly disposed on at least a portion of the main body to suspend the main body in response to being worn by a user;

a plurality of cameras removably disposed on at least a portion of the strap assembly to record a video of a predetermined duration;

an alarm system disposed on at least a portion of the strap assembly;

a plurality of pockets removably disposed on at least a portion of the main body to store at least one second item therein; and a sensor disposed under each of the plurality of pockets, such that the alarm system performs at least one of emitting an alarm sound, illuminating a light, and displaying a word on an LED display in response to the sensor detecting at least one of the plurality of pockets has been detached from the main body.

* * * * *